US006029314A

United States Patent [19]

Klüting et al.

[11] Patent Number: 6,029,314

[45] Date of Patent: Feb. 29, 2000

[54] DOOR LOCK FORMED INTEGRALLY WITH A SEPARABLE DOOR HINGE FOR A MOTOR VEHICLE DOOR

[75] Inventors: Bernd-Alfred Klüting, Radevormald; Alexander Zernikel, Herzogenaurach; Detlef Görgens, Wermelskirchen; Rolf Fleischhauer, Fürth, all of Germany

[73] Assignee: ED. Scharwächter GmbH, Remscheid, Germany

[21] Appl. No.: 09/133,092

[22] Filed: Aug. 12, 1998

[30] Foreign Application Priority Data

Aug. 12, 1997 [GB] United Kingdom ..... 197 34 841

[51] Int. Cl.[7] ..... E05D 11/10

[52] U.S. Cl. ..... 16/334; 16/330; 16/322

[58] Field of Search ..... 16/334, 330, 328, 16/329, 331, 332, 352, 353, 312–314, 299, 300, 321, 322

[56] References Cited

U.S. PATENT DOCUMENTS 4,829,633 5/1989 Kassner ..... 16/322

5,173,993 12/1992 Baker ..... 16/329

5,878,463 3/1999 Kluting et al. ..... 16/334

*Primary Examiner*—Chuck Y. Mah

*Attorney, Agent, or Firm*—Brown & Wood, LLP

[57] ABSTRACT

A door lock formed integrally with a motor vehicle door hinge and including a housing, a first bearing ring forming a holding element with a curved running track concentric with a pin axis and a plurality of detent points, a plurality of braking and locking members rotatable about respective axes extending transverse to a hinge pin axis, a spring for biasing the braking and locking members into engagement with the holding element, a second, flat-surface, bearing ring for engaging the bearing and locking members opposite the first bearing ring, and a cage for receiving the braking and locking members, with the cage and the first, holding element-forming, bearing ring being alternatively fixedly connectable with the hinge pin and the one of the first and second hinge halves without a possibility of rotation relatively to the hinge pin and the hinge half, respectively.

12 Claims, 3 Drawing Sheets

DOOR LOCK FORMED INTEGRALLY WITH A SEPARABLE DOOR HINGE FOR A MOTOR VEHICLE DOOR

BACKGROUND OF THE INVENTION

1. Field of the Invention

The present invention relates to a door lock formed integrally with a motor vehicle door hinge having a first hinge half connectable with one part of a door assembly, a door or a door pillar, a second hinge half connectable with another part of the door assembly, and a hinge pin for connecting the first and second hinge halves for a rotational movement relative to each other and supported in one of the first and second hinge halves with a running fit and fixedly secured in another of the first and second hinge halves for joint rotation with the another of the first and second hinge halves, with the door lock including a housing, a holding element having at least partially curved running track concentric with the hinge pin axis and having a plurality of detent points, a plurality of braking and locking members formed as rolling bodies and rotatable about respective axes extending transverse to the hinge pin axis; and a spring for biasing the braking and locking members into engagement with the holding element.

2. Description of the Prior Art

The prior art discloses door locks, which are formed integrally with separable door hinges and in which the braking and locking members are formed as rolling bodies rotatable about support axles extending transverse to the hinge pin axis and engaging, under a biasing force of a loading spring supported against a free end of the hinge pin, in indentation of at least partially curved running track concentric with the hinge pin axis and provided with detent points and which is formed in an end surface of collar concentric with the hinge pin axis. The rolling bodies, which form the braking and locking bodies are supported on a carrier which is formed as a metal part. The spring biasing force is applied to the carrier which is connected with the hinge pin for joint rotation therewith. In this type of door locks a support member, to which the spring biasing force is applied and which is form-lockingly connected with the carrier of the braking and locking members by an axial toothing provided on the carrier for joint rotation with the carrier, is also formed as a metal part.

Such formation of a door lock permits to manufacture a door hinge-door lock assembly in a cost-effective manner, but is associated with certain drawbacks. Specifically, on one hand, the loading spring in these door locks is formed as a stack of plate springs and acts on a middle region of the carrier of the braking and locking members, which surrounds the hinge pin. This creates unfavorable loading conditions. On the other hand, the door locks of the above-described type, have a relatively large weight. With regard to the action of the biasing force on the middle or central region of the carrier, it should be pointed out that in case of unfavorable tolerance pairs, the door cannot be retained in a predetermined braking or locking position and/or is not retained with an adequate braking or locking force. Further, the manufacturing of the door locks is still associated with relatively high costs connected with the manufacturing the holding element and with mounting of the rolling bodies on a plurality of separate axles in a carrier. The mounting of the rolling bodies on separate axles is accompanied with an additional friction which leads to a premature wear inside of the door lock. Further, mounting of the braking and locking members, which are formed as rolling bodies on a carrier at least partially results in a need for a relatively large mounting space for the door-hinge-door lock assembly.

Accordingly an object of the present invention is to so improve a known door lock, which is formed integrally with a door hinge for a motor vehicle door that an exact retaining of the door in a predetermined position is insured.

Another object of the present invention is to so improve door lock, which is formed integrally with a door hinge of a motor vehicle door, that it can be produced with minimal manufacturing costs.

A still further object of the present invention is to produce a door lock, which is formed integrally with a door hinge of a motor vehicle door, which would have reduced dimensions and weight.

A yet another object of the present invention is to produce a door lock, which is formed integrally with door hinge of a motor vehicle door, which would insure a substantially friction-free, noiseless operation of the door lock independent of tolerances.

A still further object of the invention is to produce a door lock, which is formed integrally with the door hinge of a motor vehicle door, which would insure retaining of the door in a predetermined braking or locking position with an adequate braking and locking force.

SUMMARY OF THE INVENTION

These and other objects of the present invention, which will become apparent hereinafter, are achieved by providing a door lock of the above-described type in which the holding element is formed as a first bearing ring and in which there are further provided a second, flat-surface, bearing ring, which engages the bearing and locking members opposite the first bearing ring, and a cage for receiving the braking and locking members, with the cage and the first, holding element-forming, bearing ring being alternatively fixedly connectable with the hinge pin and the one of the first and second hinge halves without a possibility of rotation relatively to the hinge pin and the one of the first and second hinge halves, respectively.

In accordance with the principle of the present invention, the braking and locking members, which are formed as rolling bodies and which cooperate with a separate braking ramp or a group of braking ramps, are received in recesses of a cage, which is formed, preferably, of a section of a flat material, with a possibility of adjustment with respect to the recess plane. Thus, the braking and locking members can be vertically adjusted under the action of an applied braking and locking force, which acts in a direction opposite to the direction of action of the spring biasing force, upon relative displacement of the holding element and the cage. In order to simplify the construction of the inventive door lock, the braking and locking member are loaded by a common loading spring. The present invention permits to significantly simplify the manufacturing process and, thereby, to substantially reduce the manufacturing costs. This is because the present invention eliminates the need in a carrier for the braking and locking members and in mounting of the braking and locking members on separate support axles. Further, in addition to simplifying manufacturing and the reduction of manufacturing costs, the present invention, as a result of the elimination of supporting axles for the braking and locking members, substantially reduces friction, which otherwise generated inside of the door lock. Thereby, the wear of the door lock components is also substantially reduced. On the other hand, the provision of the braking and locking members, which cooperate with respective separate ramps or groups of ramps formed in the holding element, insure exact retaining of the door in predetermined braking or locking positions. Furthermore, the elimination of the carrier for the braking and locking members permits to reduce the dimensions of the door lock and, thereby, the required mounting space for the door lock and the door hinge-door lock assembly.

According to a preferred embodiment of the present invention, the cage has a central opening having an inner circumferential toothing for connecting the cage to the hinge pin for joint rotation therewith, and the holding element is fixedly connected with the one of the first and second hinge halves. With such connection of the cage and the holding element, the second flat-surface bearing ring is supported against an outer surface of the one of the first and second hinge half, and the first, holding element-forming, bearing ring is formed as a thrust collar which is subjected to a biasing force of the spring. The door lock further includes guide rollers which provide for an axial displacement of the thrust collar but fixedly connect the thrust member with the housing which is fixedly secured on the one of the first and second hinge halves without a possibility of rotation relative thereto.

According to a further preferred embodiment of the present invention, the first, holding element-forming, bearing ring is supported against an outer surface of the one of the first and second hinge halves and is fixedly connected therewith without a possibility of rotation relative thereto. The cage is connected with the hinge pin for joint rotation therewith, and the second, flat surface, bearing ring is formed as a thrust collar which abuts the braking and locking bodies and which is subjected to a biasing force of the spring. At that, the first, holding element-forming, bearing ring advantageously is provided with a circumferential toothing for connecting the first bearing ring with the housing without a possibility of rotation relative thereto, and the housing is fixedly connected with the one of the first and second hinge halves without a possibility of rotation relative thereto. The spring is formed as a helical spring supported against the housing. At that, the second bearing ring is formed as a thrust collar for transmitting a biasing force of the helical spring to the bearing and locking members. The door lock further comprises a pressure-distributing member and a rolling bearing located between the helical spring and the thrust collar for transmitting the biasing force to the thrust collar.

According to a still further embodiment of the present invention, it is contemplated that the first, holding element-forming, bearing ring is supported against an outer surface of the one of the first and second hinge halves and is connected to the hinge pin for joint rotation therewith. The cage is fixedly connected with the housing which is fixedly connected to the one of the first and second hinge halves, without a possibility of rotation relative thereto. The second, flat-surface, bearing ring is formed as a thrust collar. The door lock further includes a pressure-distributing ring and a rolling bearing located between the spring, which is formed as a helical spring, and the thrust collar for transmitting a biasing force of the spring to the thrust collar. While in the embodiments discussed above, the braking and locking members are formed as conical rollers, according to the present invention, the formation of the braking and locking members as balls is also contemplated.

According to yet a further embodiment of the present invention, it is contemplated that the first, holding element-forming, bearing ring is supported against an outer surface of the one of the first and second hinge halves and is fixedly connected to the one of the first and second hinge halves without a possibility of rotation relative thereto. The cage is formed as a unit with a second, flat-surface, bearing ring, which is formed as a thrust collar, and a spring-receiving casing. The casing has toothing means for connecting the casing to free end of the hinge pin. In this embodiment, the cage is formed by bottom of the spring-receiving casing, with the bottom being provided with free cut-outs which form recesses for receiving the braking and locking members.

BRIEF DESCRIPTION OF THE DRAWINGS

The features and objects of the present invention will become more apparent, and the invention itself will be best understood from the following detailed description for the preferred embodiments when read with reference to the accompanying drawings, wherein.

DETAILED DESCRIPTION OF THE PREFERRED EMBODIMENTS

Figure 1:
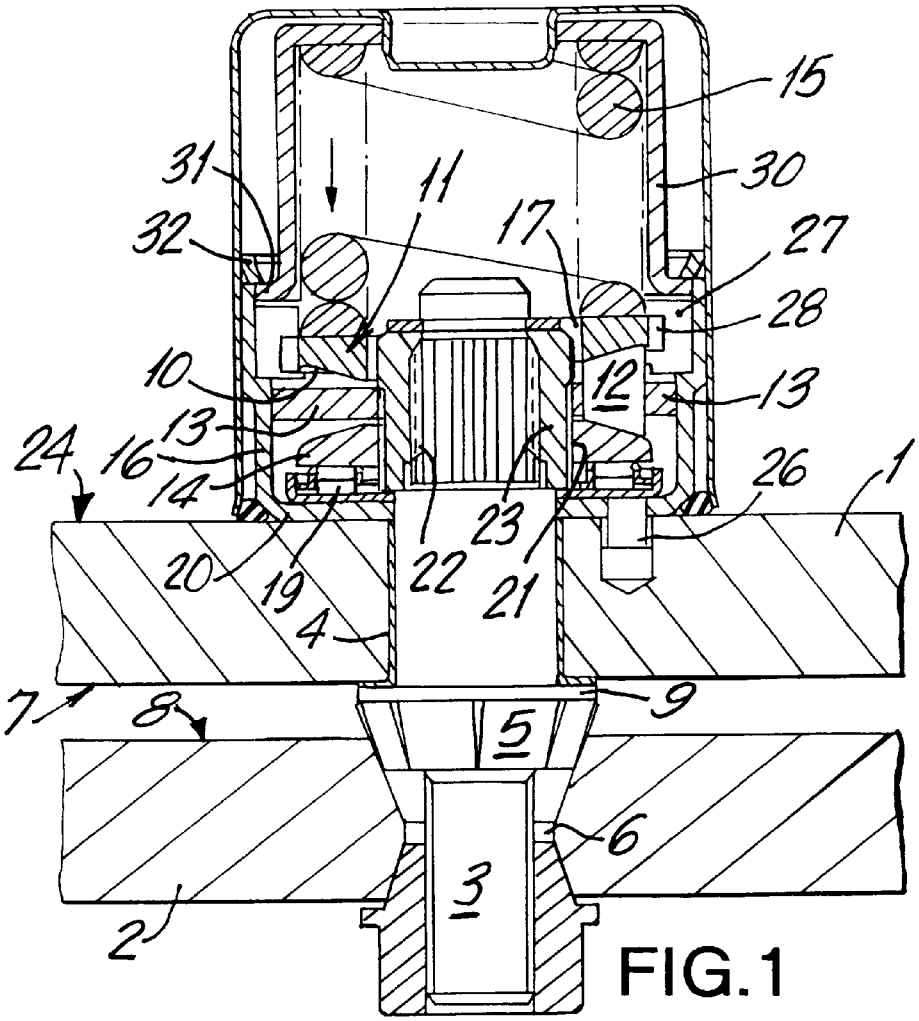
FIG. 1 shows a longitudinal cross-sectional view of a first embodiment of a door lock according to the present invention which is formed integrally with a separable door hinge for a motor vehicle.

A door hinge for a motor vehicle door, with which a door lock according to the present invention is integrally formed, includes first and second hinge halves 1 and 2, which are connected, respectively, to two parts of a door arrangement (not shown in the drawings), and a hinge pin 3 which pivotally connects the two hinge halves 1 and 2. The hinge pin 3 is supported in the first hinge half 1 for rotation relative thereto by a bearing sleeve 4 made from a maintenance-free bearing material, and in which the hinge pin 3 is supported with a running fit. The hinge pin 3 is supported in a gudgeon 6 of the second hinge 2 for joint rotation therewith, in an assembled condition of the hinge, with radially extending, form-lockingly operating means 5. The hinge pin 3 has a shoulder 9 which is engaged between adjacent surfaces 7 and 8 of the two hinge halves 1 and 2, respectively, and has a cone projecting from the shoulder 9 toward the end of the hinge pin 3 and cooperating with the form-lockingly operating means 5. The form-lockingly operating means 5 has a corresponding, complementary conical widening formed in the gudgeon 6 of the hinge half 2.

The inventive door lock, which is formed integrally with the door hinge includes a holding element 11, which is formed by a first bearing ring and is provided with detent points 10, and a plurality of braking and locking members 12 which cooperate with the holding device 11. The door lock further includes a cage 13 for supporting the braking and locking members 12, a flat-surface; bearing ring 14, and a spring 15 for biasing the braking and locking members 12. The entire door lock is located in a housing 16. In the embodiment of the door lock according to the present invention, the holding element 11 is formed by a thrust ring or collar 17 which lies on the braking and locking members 12, which are formed as conical rollers. The thrust collar 17 is concentric with the hinge pin 3 and is axially adjustable relative thereto. The thrust collar 17 is supported in the housing 16 with a possibility of an axial displacement therein. The braking and locking members 12 are supported in recesses 18 of the cage 13 for rotation about axes extending transverse to the axis of the hinge pin. The flat-surface bearing ring 14 is supported against a bottom 20 of the housing 16 by a rolling bearing 19. The cage 13 is formed of a section of a flat material and is secured to the hinge pin 3 for joint rotation therewith with a carrier sleeve 23. The cage 13 is secured to the carrier sleeve 23 by an outer toothing 21, with the sleeve 23 being secured to the hinge pin 3 by an outer toothing 22. The housing 16 has its bottom 20 abutting the outer surface 24 of the first hinge half 1 and is secured to the first hinge half 1 with studs 26 without a possibility of rotation relative to the first hinge half. The thrust collar 17, which forms the holding element 11 and is provided with the detent points 10, is secured to the housing 16 without a possibility of rotation relative thereto but with a possibility of axial displacement relative thereto by a slide-in guide. The slide-in guide is formed by standard rollers 27 the axes of which extend parallel to the axis of the hinge pin 3. The rollers 27, on one hand, engage in dome-shaped recesses 28, which are formed in the outer circumferential surface of the thrust collar 17, and on the other hand, form-lockingly engage in radial indentations 29, which are formed in the inner surface of the housing 16. The rollers 27 have an axial length which exceeds the height of the thrust collar 17 at least by the height of the detent points 10 of the holding device 11. The loading spring 14, which biases the thrust collar 17 into engagement with the braking and locking members 12, is formed by a helical spring. The loading spring 14 is supported against a cover 30 of the housing 16. The cover 30 is supported against edge portions 32 of the edge of the housing 16 and is secured to the housing 16 with corresponding edge portions 31 provided on the cover 30.

Figure 2:
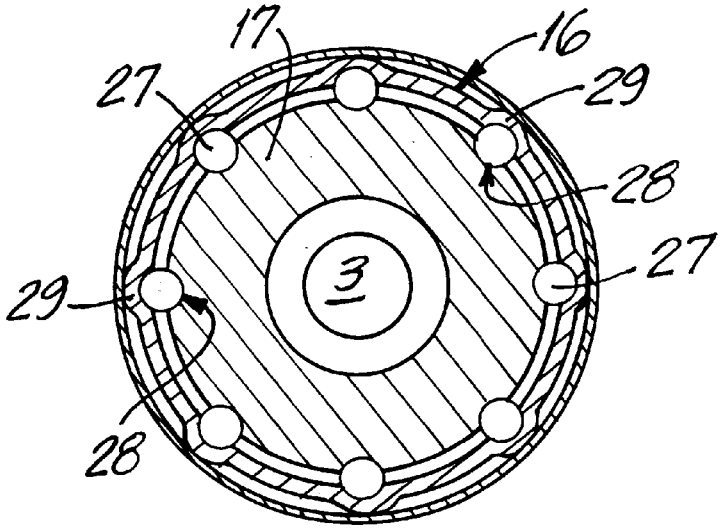
FIG. 2 shows a cross-sectional view along line 2—2 in FIG. 1.
Figure 4:
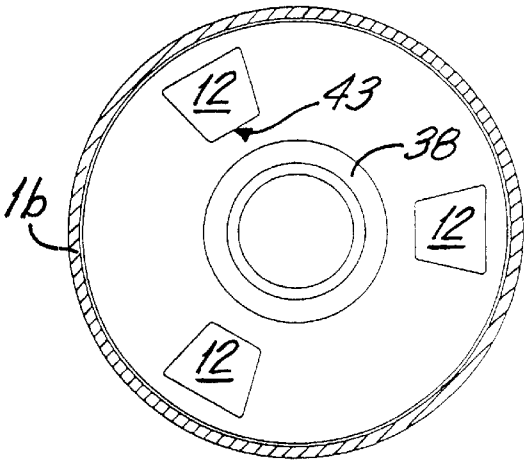
FIG. 4 shows a cross-sectional view along line 4—4 in FIG. 3.
Figure 5:
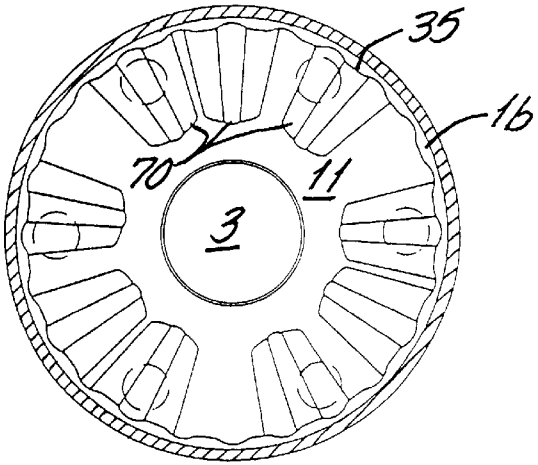
FIG. 5 shows a cross-sectional view along line 5—5 in FIG. 3.
Figure 3:
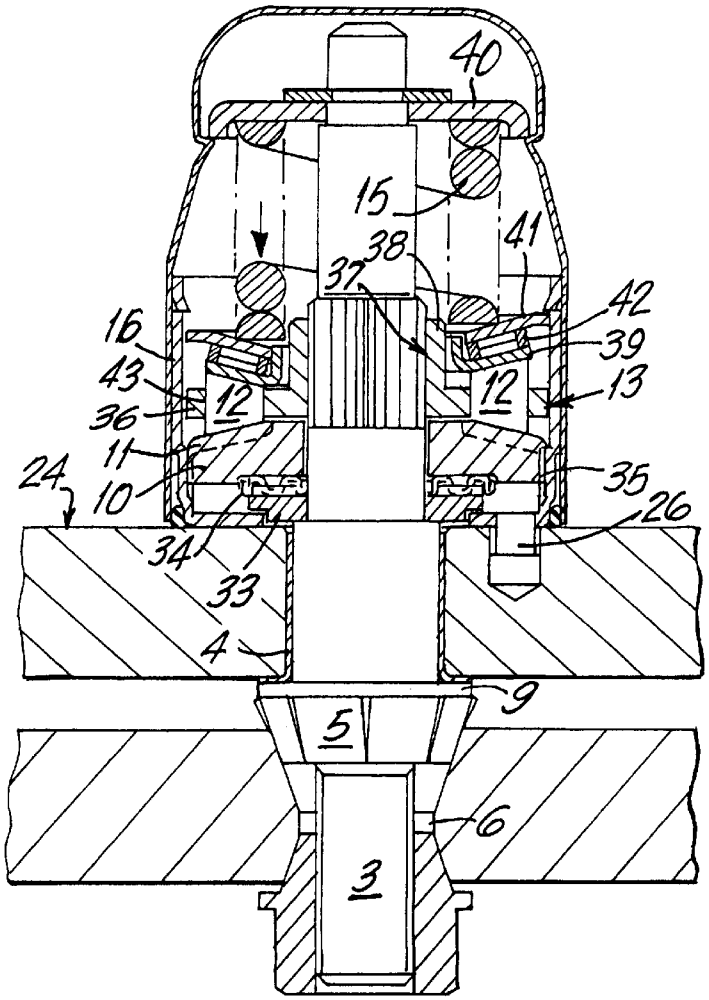
FIG. 3 shows a longitudinal cross-sectional view of a second embodiment of a door lock according to the present invention which is formed integrally with a separable door hinge for a motor vehicle.

In the embodiment of a door lock according to the present invention, which is shown in FIGS. 3–5, the holding element 11, which is provided with the detent points 10, is supported against the upper surface 24 of the first hinge half 1 by a support disc 33 and a bearing 34 and is secured to the housing 16, without a possibility of rotation relative thereto, by a circumferential toothing 35. The housing 16 is secured to the first hinge half 1, without a possibility of rotation relative thereto, by studs 26. The cage 13, in which the braking and locking members 12 which, as in the embodiment of FIGS. 1–2, are formed as conical rollers, are supported, has a disc 36 having a plurality of radially extending recesses 43 having a shape corresponding to a cross-sectional shape of the braking and locking members 12 for receiving the same. The disc 36 is secured to the hinge pin 3 for joint rotation therewith by a sleeve 38, with the sleeve 38 being secured to the hinge pin 3 by an inner toothing 37. The braking and locking members 12 are biased by loading spring 14 which is supported against a free end of the hinge pin 3 by a support plate 40. The spring 14 acts on a thrust collar 39, which is formed as a flat-surface bearing ring and engages the braking and locking members 12. The spring 15 applies a biasing force against the trust collar 39, which is formed as a sheet metal stamped part, via a pressure distributing ring 41 and a rolling bearing 42. As shown in FIG. 5, the detent points 10, which are formed as detent indentations, are arranged in groups in the holding element 11, with each bearing and locking member being associated with its own group of detent points 10. As can be seen in FIG. 4, the conical rollers, which form the braking and locking members 12, are vertically adjustable in the recesses 43 formed in the cage 13 in a direction parallel to the axis of the cage 13.

Figure 6:
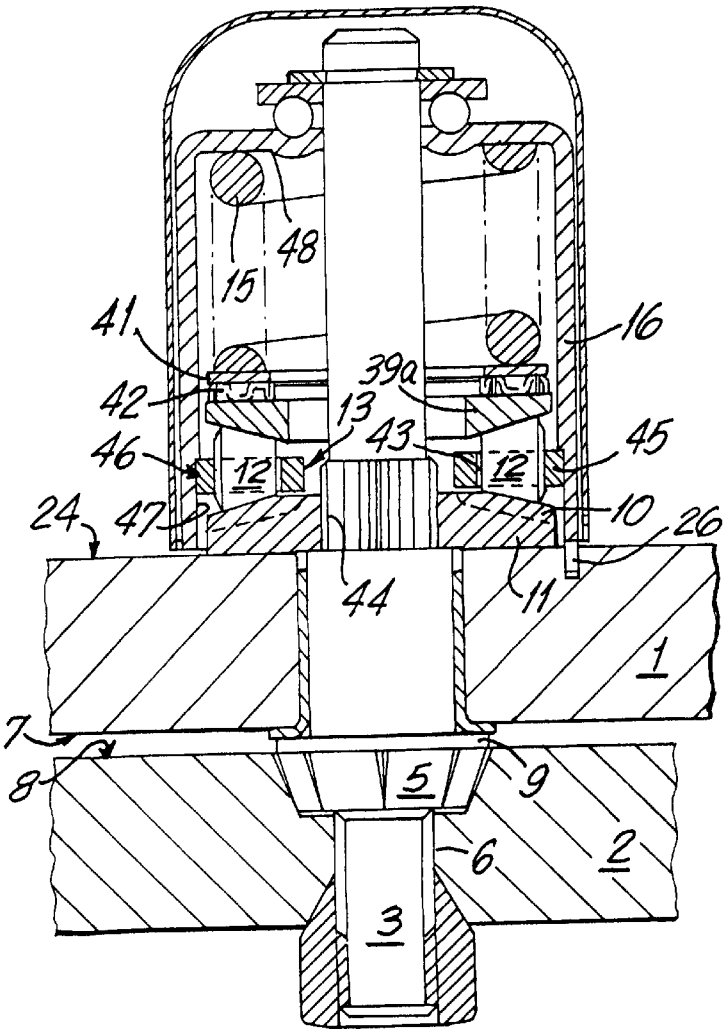
FIG. 6 shows a longitudinal cross-sectional view of a third embodiment of a door lock according to the present invention which is formed integrally with a separable door hinge for a motor vehicle.

The embodiment of a door lock according to the present invention, which is shown in FIG. 6, differs from the embodiment shown in FIG. 3 in that the holding element 11, which is provided with detent points 10, is formed as a shaped part and is directly supported against the outer surface 24 of the first hinge half 1. The holding element 11 is secured to the hinge pin 3 for joint rotation therewith with an inner toothing 44 formed in the central bore of the holding element 11. The cage 13, in which the braking and locking members 12 are supported, is fixedly connected with the housing 16. The cage 13 is formed as a circular disc 45 having an outer circumferential toothing 46 which is engaged in the widened portion 47 of the housing 16, e.g., with a press fit. The housing 16 is fixedly secured to the first hinge half 1, with a stud 26. The inventive door lock shown in FIG. 6 further differs from that shown in FIG. 3, in that the thrust collar 39 is formed as a massive shaped part, and the pressure or loading spring 14 is supported against a bottom 48 of the pot-shaped housing 16.

Figure 7:
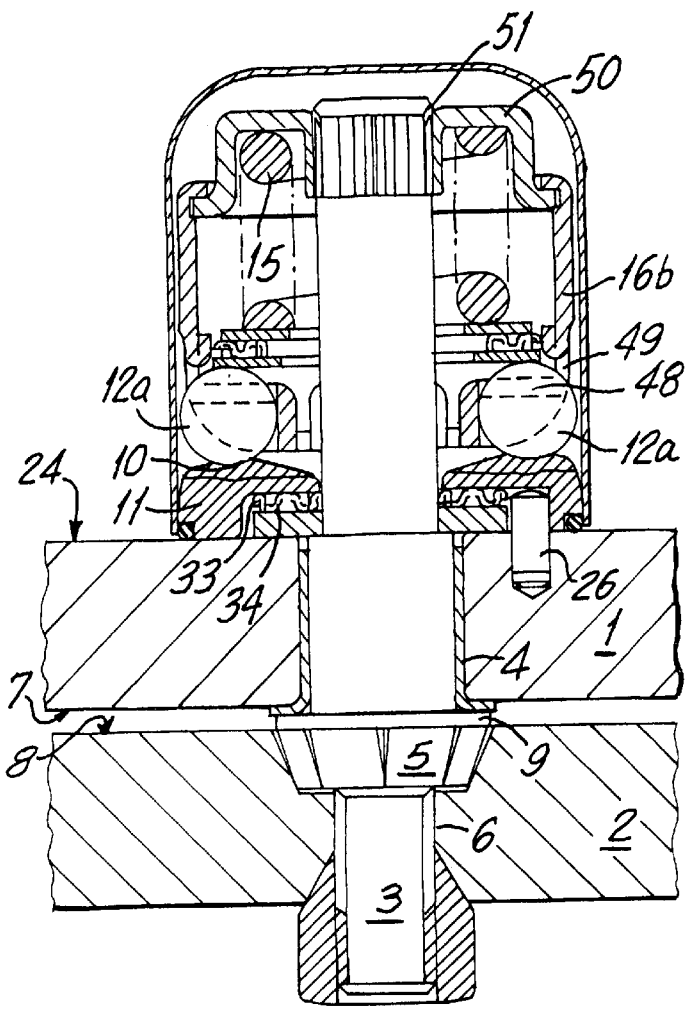
FIG. 7 shows a longitudinal cross-sectional view of a first embodiment of a door lock according to the present invention which is formed integrally with a separable door hinge for a motor vehicle.

A door lock according tot he present invention, which is shown in FIG. 7, differs from the embodiments of the inventive door lock, which are shown in FIGS. 1–6, in that the braking and locking members 12 are formed as balls. The holding element 11, which is formed as a bearing ring, is supported against the outer surface 24 of the first hinge half 1 by a support disc 33 and a bearing 34, and is fixedly secured to the first hinge half 1 with a stud 26.

The cage 13 for supporting the braking and locking members 12 is formed as a unit with a thrust collar 39, which forms the second bearing ring and is fixedly secured to the hinge pin 3 for joint rotation therewith, a pressure distributing ring 41, a rolling bearing 42 located between the thrust collar 39 and the pressure distributing ring 41, and a casing 166 in which the loading spring 14 is received. The cage 13 is formed by a bottom 48 of the casing 166, in which free-cut recess 49 for receiving the braking and locking members 12 are provided. The spring 14, which is formed, as in other embodiments, as a helical spring and which acts against the trust collar 39, is supported against a cover 50 which is fixedly secured to the hinge pin 3 with an inner toothing 51 and which is further fixedly secured to the spring-receiving casing 166.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A door lock formed integrally with a motor vehicle door hinge having a first half connectable with one part of a door assembly, a door or a door pillar, a second hinge half connectable with another part of the door assembly, and a hinge pin for connecting the first and second hinge halves for a rotational movement relative to each other and supported in one of the first and second hinge halves with a running fit and fixedly secured in another of the first and second hinge halves for joint rotation with another of the first and second hinge halves, the door lock comprising:

a housing;

a first bearing ring forming a holding element having at least partially curved running track concentric with a hinge pin axis and a plurality of detent points;

a plurality of braking and locking members formed as rolling bodies and rotatable about respective axes extending transverse to a hinge pin axis;

spring means for biasing the braking and locking members into engagement with the holding element;

a second flat-surface bearing ring for engaging the first bearing ring and locking members and located opposite the first bearing ring;

a cage for receiving the braking and locking members and located between the first and second bearing rings; and means for fixedly connecting one of the cage and the first, holding element-forming, bearing ring with one of the hinge pin and the one of the first and second hinge halves or for fixedly connecting another of the cage and the first, holding element-forming, bearing ring with another of the hinge pin and the one of the first and second hinge halves.

2. A door lock as set forth in claim 1, wherein the cage is formed as a section of a flat material having recesses for receiving the braking and locking members, and the braking and locking members are formed as conical rollers received in the recesses, and wherein the door lock further comprises means for adjusting a position of the rollers in a direction transverse to a plane of the recesses.

3. A door lock as set forth in claim 1, wherein the cage has a central opening, and the connecting means includes an inner circumferential toothing formed in the central opening for connecting the cage to the hinge pin for joint rotation therewith.

4. A door lock as set forth in claim 1, wherein the second flat-surface bearing ring is supported against an outer surface of the one of the first and second hinge half, wherein the first, holding element-forming, bearing ring is formed as a thrust collar which is subjected to a biasing force of the spring means, and wherein the connecting means comprises guide means-forming rollers which provide for an axial displacement of the thrust collar but fixedly connect the thrust collar with the housing, and means for fixedly securing the housing to the one of the first and second hinge halves without a possibility of rotation relative thereto, and means for form-lockingly connecting the cage with the hinge pin for joint rotation therewith and for axial displacement relative thereto.

5. A door lock as set forth in claim 4, further comprising a roller bearing for supporting the second, flat-surface bearing ring on the one of the first and second hinge halves.

6. A door lock as set forth in claim 1, wherein the first, holding element-forming, bearing ring is supported against an outer surface of the one of the first and second hinge halves, and the connecting means comprises means for connecting the first bearing ring with the one of the first and second hinge halves.

7. A door lock as set forth in claim 1, wherein the connecting means comprises a circumferential toothing provided on the first, holding element-forming, bearing ring for fixedly connecting the first ring with the housing, and means for fixedly connecting the housing with the one of the first and second hinge halves.

8. A door lock as set forth in claim 1, wherein the spring means is formed as a helical spring supported against the housing which is fixedly connected with the one of the first and second hinge halves without a possibility of rotation relative thereto, wherein one of the first and second hinge halves without a possibility of rotation relative thereto, wherein one of the first and second bearing rings is formed as a thrust collar for transmitting a biasing force of the helical spring to the bearing and locking members, and wherein the door lock further comprises a pressure-distributing member and a roller bearing located between the helical spring and the thrust collar for transmitting the biasing force to the thrust collar.

9. A door lock as set forth in claim 1, wherein the first, holding element-forming, bearing ring is supported against an outer surface of the one of the first and second hinge halves, and the connecting means comprises means for connecting the first bearing ring to the hinge pin for joint rotation therewith, means for fixedly connecting the cage with the housing, and means for fixedly connecting the housing to the one of the first and second hinge halves without a possibility of rotation relative thereto, wherein the second, flat-surface, bearing ring is formed as a thrust collar, and wherein the door lock further comprises a pressure-distributing ring and a roll bearing located between the spring means, which is formed as a helical spring, and the thrust collar for transmitting a biasing force of the spring to the thrust collar.

10. A door lock as set forth in claim 1, wherein the braking and locking members are formed as balls.

11. A door lock as set forth in claim 1, wherein the first, holding element-forming, bearing ring is supported against an outer surface of the one of the first and second hinge halves, and the connecting means comprises means for connecting the first bearing ring to the one of the first and second hinge halves, wherein the cage is formed as a unit with a second, flat-surface, bearing ring, which is formed as a thrust collar, and a spring means-receiving casing, and wherein the connecting means further comprises toothing means provided on the casing for connecting the casing to a free end of the hinge pin.

12. A door lock as set forth in claim 11, wherein the cage is formed by a bottom of the spring means-receiving casing, with the bottom of the spring means-receiving casing, with the bottom being provided with free cut-outs which form recesses for receiving the braking and locking members.

* * * * *

UNITED STATES PATENT AND TRADEMARK OFFICE

CERTIFICATE OF CORRECTION

PATENT NO. : 6,029,314

DATED : February 29, 2000

INVENTOR(S) : Bernd-Alfred Klüting, et al

It is certified that error appears in the above-identified patent and that said Letters Patent is hereby corrected as shown below:

Title page, item [30],

{30} Foreign Application Priority Data , should read as follows:

Aug. 12, 1997 [DE] Germany.....197 34 841

Signed and Sealed this

Fourteenth Day of November, 2000

*Attest:*

Q. TODD DICKINSON

*Attesting Officer*

*Director of Patents and Trademarks*